United States Patent [19]

Hayes

[11] 4,381,065

[45] Apr. 26, 1983

[54] CONTINUOUS DISCHARGE AEROSOL ACTUATOR

[75] Inventor: Thomas Hayes, Westport, Conn.

[73] Assignee: Precision Valve Corporation, Yonkers, N.Y.

[21] Appl. No.: 268,262

[22] Filed: May 29, 1981

[51] Int. Cl.[3] ..... B65D 83/14

[52] U.S. Cl. ..... 222/153; 222/402.14

[58] Field of Search ..... 222/153, 182, 402.13, 222/402.14, 402.15, 402.11

[56] References Cited

U.S. PATENT DOCUMENTS

| | | | |
|---|---|---|---|
| 3,109,565 | 11/1963 | Kutik | 222/402.15 X |
| 3,185,350 | 5/1965 | Abplanalp et al. | 222/402.14 X |
| 3,269,614 | 8/1966 | Abplanalp | 222/402.13 |
| 3,610,479 | 10/1971 | Venus, Jr. | 222/402.13 |
| 4,013,231 | 3/1977 | Van Veldhoven | 222/402.15 X |

*Primary Examiner*—David A. Scherbel

*Attorney, Agent, or Firm*—Davis Hoxie

[57] ABSTRACT

An actuator cap for a pressurized aerosol dispenser includes an integrally hinged actuator tab secured with tamper proof frangible webs. The webs must be broken and the tab rotated about the hinge to engage the container valve stem. Detents on the tab and cap latch the valve open for continuous discharge.

3 Claims, 6 Drawing Figures

CONTINUOUS DISCHARGE AEROSOL ACTUATOR

BACKGROUND

Various products are dispensed by presurized aerosol dispensers. Some products such as fumigants, air fresheners, and fogging insecticides benefit from an actuator which opens and holds open the dispenser valve permitting the user to leave the aerosol dispenser as it continues to dispense the contents to the air. Examples of aerosol dispenser actuators having the capability of continuous, unattended dispensing are found in Scoggin, Jr. et al. U.S. Pat. No. 3,081,918, Alplanalp U.S. Pat. No. 3,260,416, Steinkamp U.S. Pat. No. 3,137,414, Beres et al. U.S. Pat. No. 3,305,144, Doblin, U.S. Pat. No. 3,314,577, and Scheck U.S. Pat. No. 3,325,064.

BRIEF SUMMARY

The present invention is a continuous discharge actuator which combines in a single piece molding a vertical dispensing nozzle, means to hold the aerosol dispensing valve open, a tamper prevention means to assure product integrity, a manner of use too complex for small children to be likely to achieve, and an appearance similar to a decorative closure cap.

THE DRAWINGS

DETAILED DESCRIPTION OF A PREFERRED EMBODIMENT

Figure 1:
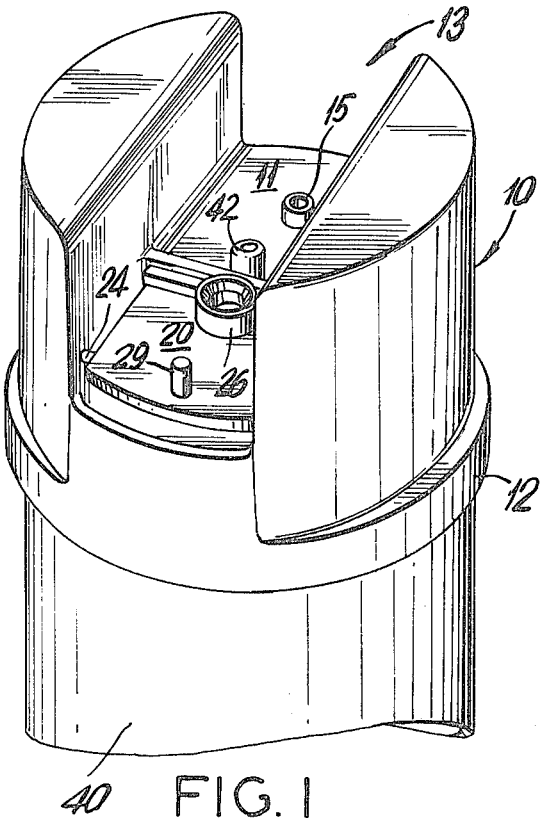
FIG. 1 is a perspective view of an aerosol container having the actuator cap of the present invention in the condition as purchased and before use.

The actuator is an integral molding of a flexible plastic such as a polyolefin. The lower margin 12 of the cylindrical cap body 10 is adapted to be secured to the chime bead of an aerosol container 40 by a snap-fit. The upstanding hollow valve stem 42 of the aerosol container valve protrudes through an aperture 14 in the flat horizontal floor 11 of a finger receiving groove 13 which extends transversely of the cap 10.

A finger tab 20, as initially molded and before use, extends generally in the plane of the floor 11. The tab 20 is provided at the inner end with an integral, flexible hinge portion 22 and near the outer end with frangible webs 24 molded integrally with the tab 20 and cap 10. The webs 24 secure the tab 20 against movement until use and must be broken before the tab can be rotated about the hinge 22. The tab 20 is provided with a valve stem receiving socket 26 which leads to a discharge orifice 28 on the other side of the tab 20. A pin 29 protrudes from the valve stem socket side of the tab 20. Floor 11 is provided with a socket 15 to receive pin 29 with sufficient friction to retain the pin 29.

Figure 2:
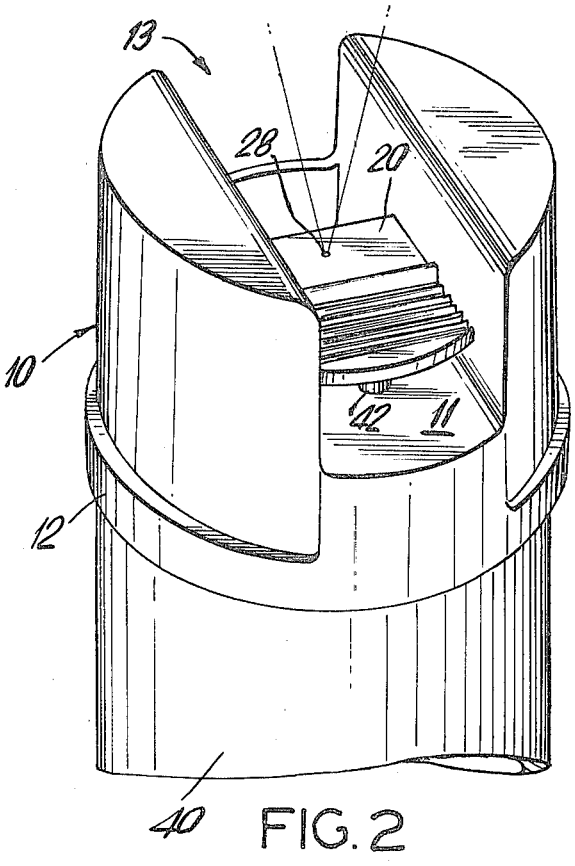
FIG. 2 is a view similar to FIG. 1 showing the actuator in use.
Figure 3:
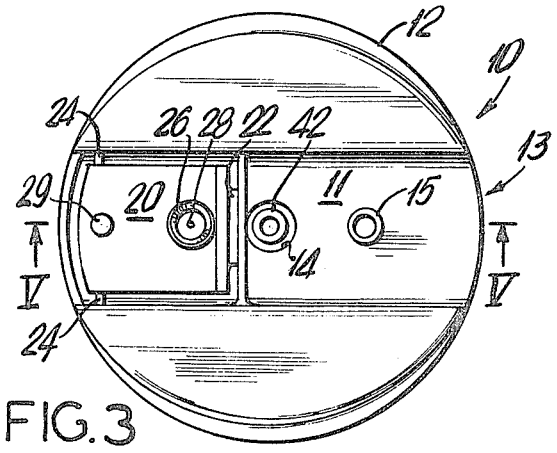
FIG. 3 is a top view of the actuator of FIG. 1.
Figure 4:
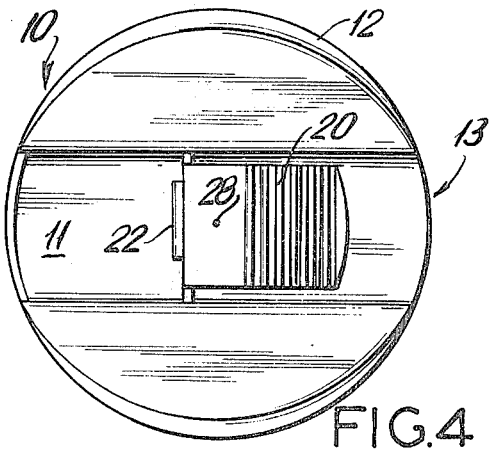
FIG. 4 is a top view of the actuator of FIG. 2.
Figure 5:
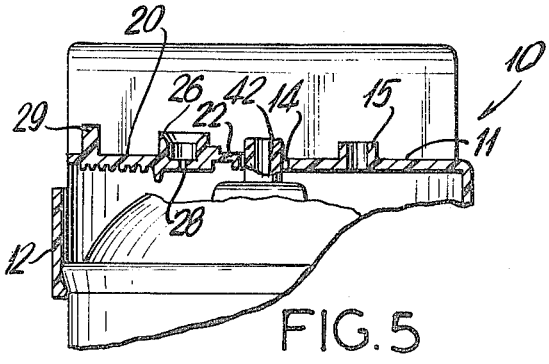
FIG. 5 is a cross-sectional view taken along plane V—V of FIG. 3.
Figure 6:
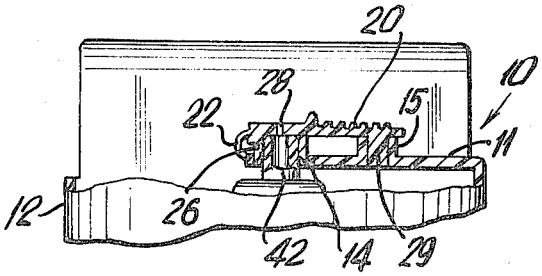
FIG. 6 is a cross-sectional view similar to that of FIG. 6, but showing the actuator in use.

In operation, the user must prise tab 20 upwardly to break the frangible webs 24. The frangible webs 24 serve to secure the tab 20 against movement until use is desired and serve as a visible and tactile indication of tampering or prior use of the container. The tab 20 is then free to hinge over from the position shown in FIGS. 1,3 and 5 to that shown in FIGS. 2,4 and 6. When folded over, valve stem receiving socket 26 engages the valve stem 42 with discharge orifice 28 in communication with the valve stem passage. Pin 29 frictionally engages in socket 15 when the tab 20 is depressed by the user to thereby open the discharge valve. The frictional retention of pin 29 in socket 15 latches the tab 20 down to maintain the discharge valve open. The product issues vertically through orifice 28 as a spray or fog. Discharge continues until the user lifts tab 20 out of engagement of pin 29 and socket 15. The foregoing manner of operation is generally beyond the skill level of small children and thus serves as a deterrent against unwanted use by small children.

The entirety of the actuator is molded as a single piece. No assembly of parts is required. The actuator easily can be assembled to the filled presurized dispenser by automatic machinery or by hand. No alignment or orientation problems are presented. In appearance, the actuator resembles the now conventional decorative overcap found on many aerosol products.

I claim:

1. A one-piece integrally molded actuator for a presurized aerosol dispenser comprising a generally cylindrical cap body having a generally horizontal surface portion which includes a central aperture through which the valve stem of the dispenser protrudes, an actuator tab integral with said horizontal surface portion and connected thereto at the inner end of the tab by a flexible hinge portion, said tab being detachably connected to the cap body near the outer end of the tab by a frangible web, a first side of said tab including a valve stem receiving socket for fitment upon the dispenser valve stem when the tab has been inverted by rotation about said hinge portion, said valve stem receiving socket being in communication with a discharge orifice located on the other side said tab, the first side of said tab also including detent means cooperative with detent means located on the horizontal surface portion of said cap body to retain the tab in the inverted position for latching the container valve open.

2. The actuator of claim 1 wherein said generally horizontal surface portion is a floor of a finger receiving groove extending transversely of said cap body.

3. The actuator of claim 1 wherein the detent means of the tab and surface portion comprise a pin and a socket for frictional retention of the pin.

* * * * *